US006724294B2

(12) United States Patent
Morbitzer

(10) Patent No.: US 6,724,294 B2
(45) Date of Patent: Apr. 20, 2004

(54) TEMPERATURE LIMITER

(75) Inventor: Hans-Peter Morbitzer, Atzenbrugg (AT)

(73) Assignee: Electrovac, Fabrikation elektrotechnischer Spezialartikel Gesellschaft m.b.H., Klosterneuburg (AT)

( * ) Notice: Subject to any disclaimer, the term of this patent is extended or adjusted under 35 U.S.C. 154(b) by 0 days.

(21) Appl. No.: 10/379,172

(22) Filed: Mar. 4, 2003

(65) Prior Publication Data

US 2003/0146818 A1 Aug. 7, 2003

Related U.S. Application Data

(62) Division of application No. 10/037,253, filed on Jan. 3, 2002.

(30) Foreign Application Priority Data

Jan. 10, 2001 (EP) ..... 01890007

(51) Int. Cl.[7] ..... H01H 37/46; H01H 37/48

(52) U.S. Cl. ..... 337/394; 337/382; 337/393

(58) Field of Search ..... 337/298, 382, 337/383, 393, 394, 398, 417

(56) References Cited

U.S. PATENT DOCUMENTS

| | | | | | |
|---|---|---|---|---|---|
| 3,029,329 | A | * | 4/1962 | Bolesky | 337/386 |
| 3,243,557 | A | * | 3/1966 | Fairbanks | 337/394 |
| 3,327,946 | A | * | 6/1967 | Benson | 236/48 R |
| 3,921,198 | A | * | 11/1975 | Pohl | 337/337 |
| 4,008,454 | A | * | 2/1977 | Bowling | 337/386 |
| 5,055,819 | A | * | 10/1991 | Goessler et al. | 337/394 |
| 5,243,315 | A | * | 9/1993 | Rose | 337/354 |
| 5,310,993 | A | * | 5/1994 | McWilliams et al. | 219/448.19 |
| 5,420,398 | A | * | 5/1995 | Petri et al. | 219/505 |
| 5,627,507 | A | | 5/1997 | Morbitzer et al. | |
| 6,007,327 | A | * | 12/1999 | Morbitzer | 431/75 |

FOREIGN PATENT DOCUMENTS

| | | | | |
|---|---|---|---|---|
| AT | 404 776 B | | 2/1999 | |
| EP | 0 225 490 A | | 6/1987 | |
| EP | 0 279 368 A | | 8/1988 | |
| EP | 0 901 310 A | | 3/1999 | |
| EP | 901310 A2 | * | 3/1999 | H05B/1/02 |
| GB | 2339475 A | * | 1/2000 | G01K/7/16 |

* cited by examiner

*Primary Examiner*—Anatoly Vortman
(74) *Attorney, Agent, or Firm*—Henry M. Feiereisen

(57) ABSTRACT

A switch head is disclosed that can be attached to a temperature sensor having elongated expansion elements with different thermal expansion coefficients. The switch head further includes a device for measuring the displacement of the expansion elements relative to each other. Attachment means are provided for attaching at least one additional switch head. At least one opening for receiving a transfer member to transfer the relative displacement of the expansion elements to the at least one additional switch head is provided.

18 Claims, 9 Drawing Sheets

TEMPERATURE LIMITER

CROSS-REFERENCES TO RELATED APPLICATIONS

This application is a division of prior filed copending U.S. application Ser. No. 10/037,253, filed Jan. 3, 2002, which claims the priority of European Patent Application Serial No. 018 90 007.6, filed Jan. 10, 2001.

BACKGROUND OF THE INVENTION

The present invention relates to a switch head for attachment to a temperature sensor with elongated expansion elements having different thermal expansion coefficients and for receiving a device for evaluating the relative movement of the expansion elements.

Cooking areas are frequently made of a glass ceramic plate (Ceran plate) that forms a resting surface for cooking utensils and has a heating space disposed below. Such cooking areas can be heated in different ways, for example with an electric resistive heating element, halogen lamps, gas and the like. Regardless of the heating mode, the Ceran plate can be damaged or destroyed by excess heat, so that overheating has to be avoided.

For this purpose, temperature limiters are frequently used, which comprise a temperature sensor and a switch head of the type described above, which is connected with the temperature sensor. The temperature sensor is arranged in the heating space underneath the Ceran plate and is therefore exposed to substantially the same temperature as the Ceran plate.

When the temperature sensor heats up, the sensor component which can move relative to the switch head is displaced relative to the switch head, and the relative movement is transmitted to a switch via a mechanical connection—which can be a simple ram. When the temperature sensor senses that the temperature of the Ceran plate may become too high, the aforedescribed relative movement becomes so large that the switch is actuated, which decreases or disconnects the heating power supplied to the heating element.

When the cooking area is heated electrically, power can be disconnected simply by forming the switch as a normally closed switch connected in series with the heater. When the cooking area is heated with gas, then actuation of the switch closes a valve arranged in the gas supply line.

AT 404 776 describes combined switch heads which satisfy the aforedescribed function to prevent overheating. These switch heads also provide a so-called "heat indicator" which warns the user not to touch a section of the cooking area that is too hot. In addition, switch heads for temperature limiters are known which combine different additional functions.

All these embodiments, however, have in common that the switch head is formed as a single piece, which makes it impossible to enhance a switch head by adding additional functions. As a result, dedicated production lines and inventory have to be provided for each combination of those functions.

It would therefore be desirable and advantageous to provide an improved switch head which obviates the prior art shortcomings and allows easy implementation of additional functions. It would also be desirable to provide a modular temperature controller in which additional functions can be incorporated.

SUMMARY OF THE INVENTION

The invention is directed to a switch head and a temperature controller/limiter with such switch head, wherein additional functions can be the added or removed.

According to an aspect of the invention, attachment means are provided for attaching at least one additional switch head to an existing switch head. Moreover, at least one opening is provided adapted to receive a transfer member for transferring the relative movement of the expansion elements to the at least one additional switch head. In this way, the switch head can be used as an additional module for a temperature limiter.

According to one embodiment of the invention, the opening can be formed by eliminating a sidewall of the switch head, allowing a lightweight construction of the component.

According to another embodiment of the invention, an electric switching contact can be installed in the switch head for evaluating the relative movement. This arrangement provides a very simple temperature limiter, for example by connecting the switching contact in series with the resistive heating element for the cooking area.

According to yet another embodiment of the invention, the relative displacement of the expansion elements can be transferred to a device for evaluating the relative displacement. A transfer member in the form of a ram can be implemented which is moveable along with longitudinal axis in the switch head. This allows advantageously a particularly rigid and simple construction and makes it unnecessary to install an additional transfer member when the additional switch head is attached to a first switch head.

According to another embodiment of the invention, the switch heads can be covered by a cover that can be easily removed. This cover protects the first switch head from contamination and debris if no other switch head is attached to the first switch head.

According to another aspect of the invention, a temperature limiter includes a temperature sensor with elongated expansion elements having different thermal expansion coefficients and a switch head arranged in a second end region of the temperature sensor, wherein the switch head includes a device that evaluates the relative displacement of the expansion elements.

As mentioned above, such temperature limiters are known for overtemperature protection of glass ceramic cooking areas. A combination of a temperature limiter with a heat indicator is also known. However, these conventional devices do not allow a modular extension or any change in the functionality of the switch heads, such as adding or subtracting functions.

The temperature limiter of the invention includes an additional switch head with an additional device for measuring the relative displacement of the expansion elements, which the additional switch head connected to the first switch head.

In this way, the temperature limiter can be easily modified by removing the second switch head. Alternatively, additional modules can be attached to the temperature limiter.

According to another embodiment of the invention, an additional module can be provided which includes a basic module preferably made of ceramic and provided with a bore, wherein the additional module is placed over the temperature sensor by means of the bore. This provides additional functions in the region of the temperature sensor.

According to another embodiment of the invention, the additional module can be connected directly with the switch head. This provides a particularly rigid connection between the additional module and the temperature limiter.

According to another embodiment of the invention, a resistor, preferably an ohmic resistor with a temperature-dependent resistance value, can be attached to the basic module of the additional module. This enables very precise temperature measurements.

According to another embodiment of the invention, the resistor can be formed by a resistive paste which is printed onto the basic module, preferably by screen printing, which advantageously makes the design very compact. Moreover, the resistor in this embodiment can be manufactured in a single manufacturing step and attached on the basic module, thereby obviating the need for a separate process for attaching the resistor. A suitable range for the resistance value and its temperature dependence can be defined by selecting a suitable material and resistive path of the paste.

According to another embodiment of the invention, the resistor can be shielded by a heat shield to prevent the resistor from heating too quickly during the heat up process.

According to yet another embodiment of the invention, the additional module can include two electrodes attached to the basic module and forming an arc gap therebetween. This makes it possible to provide in the gas-heated cooking areas not only a aforedescribed temperature limiter, but also a device for igniting the gas inside the heating space.

According to another embodiment of the invention, the additional module can include a resistive heating element which can be attached to the basic module and implemented preferably as a helical coil. This type of heating element has a particularly simple construction and is therefore more reliable and more easily controlled as compared to other arrangements, such as a spark plug.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

The present invention relates to a switch head which can be secured to a temperature sensor. The temperature sensor has elongated expansion elements with different thermal expansion coefficients and is adapted to receive a device for evaluating the relative displacement of the expansion elements.

For a better understanding of the invention, the basic construction and a preferred application of temperature limiters provided with such switch heads will now be described.

Figure 1:
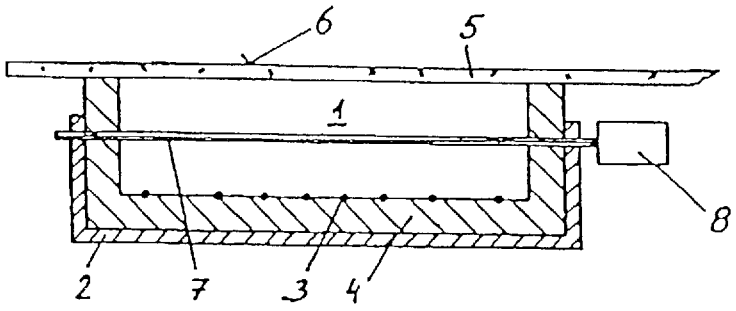
FIG. 1 shows a cross-sectional view through a cooking area with a temperature limiter taken along the line I—I shown in FIG. 2.
Figure 2:
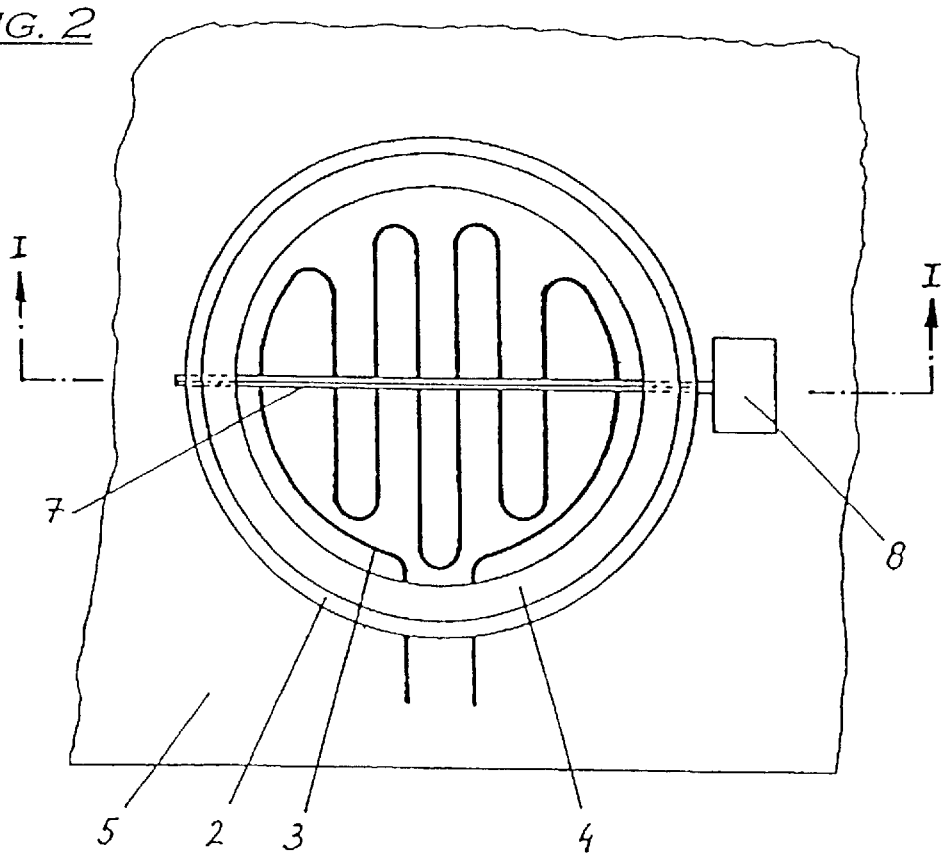
FIG. 2 is a top view of the cooking area of FIG. 1.

FIGS. 1 and 2 show a possible application for a temperature sensor 7 in connection with a switch head 8 according to the invention. It will be understood, however, that the invention is not limited to this application.

Referring now to FIG. 1, a radiant heating element 1 includes a cup 2 in which a helically wound heater coil 3, which is embedded in a packing material, is received. The radiant heating element 1 is located below the plate 5 which forms a cooking surface 6 and can be made of metal, glass ceramic and the like. The temperature sensor 7 connected with the switch head 8 is located between the cooking surface 6 and the heater coil 3. The temperature sensor 7 can be simply inserted through openings in the radiant heating element 1.

The temperature sensor 7 is exposed to the temperature that exists below the cooking surface 6 in the radiation space between the cooking surface 6 and the heater coil 3, and can hence measure this temperature.

Figure 4:
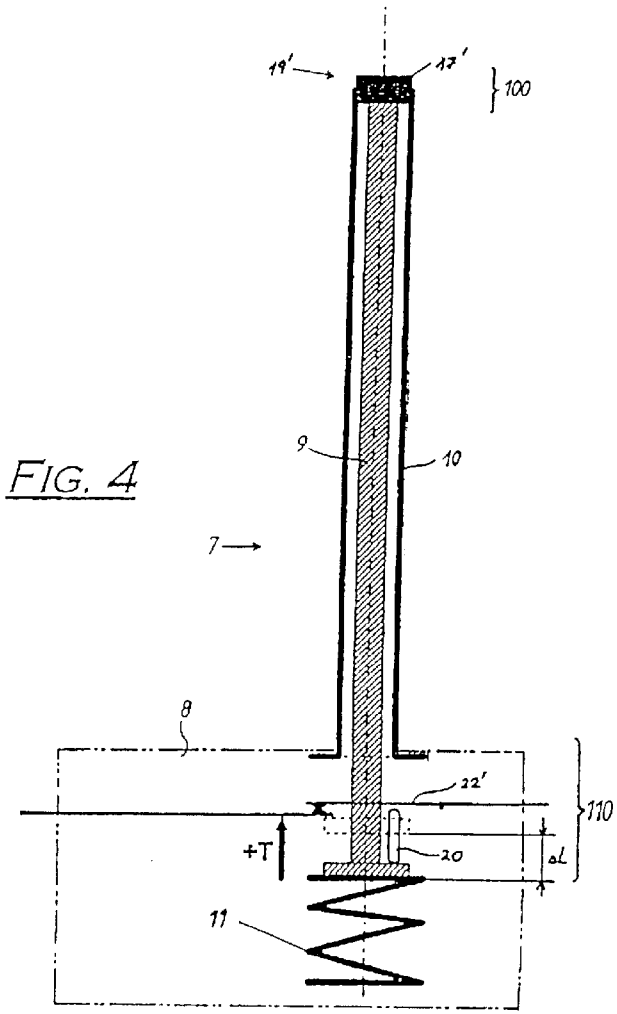
FIG. 4 is a longitudinal cross-section through a second embodiment of the conventional temperature sensor, wherein the tube has a larger thermal expansion coefficient than the rod.
Figure 3:
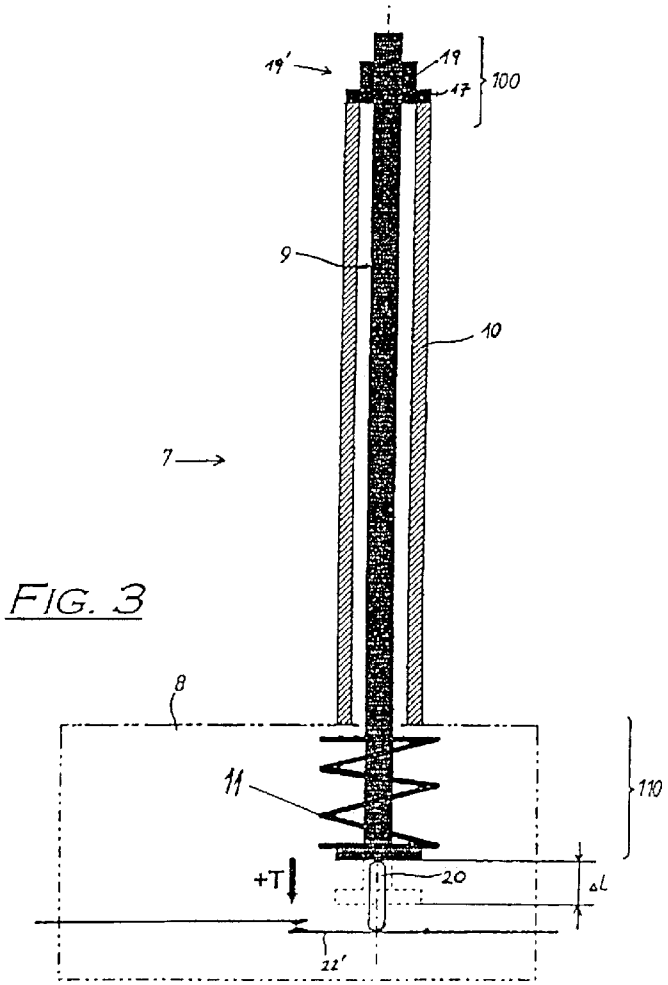
FIG. 3 is a longitudinal cross-section through a first embodiment of the conventional temperature sensor, wherein the rod has a larger thermal expansion coefficient than the tube.

Referring now to FIGS. 3 and 4, the temperature sensor 7 is made of two elongated expansion elements 9, 10 with different thermal expansion coefficients. These expansion elements 9, 10 can also be in form of a spring or can be arranged side-by-side. Preferably, a first expansion element 10 is implemented as a tube having, for example, an annular cross-section, whereas the second expansion element 9 is implemented as a rod with a preferably circular cross-section. The rod 9 can hereby be placed inside the tube 10.

As shown in FIGS. 3 and 4, the tube 10 and the rod 9 are held in a fixed spatial relationship in a first end region 100, while they are able to move relative to one another in the second end region 110, i.e., in the region of the switch head.

In the embodiment depicted in FIG. 3, the expansion coefficient of the rod 9 is greater than that of the tube 10, which can be achieved, for example, by making the rod 9 of a metal and the tube 10 of a ceramic material, such as Cordierit.

The rod 9 is fixedly secured to the tube 10 in the first end region 100 by a limit stop 19' affixed on the rod 9. The first end of the rod can hereby be supported on the first end of the tube. This limit stop 19' can also be formed, for example, by a component, which is non-releasably connected with the rod 9, for example by welding or glueing. The limit stop 19' can also be formed by a nut 19 which is screwed onto the first end of the rod 9 which has a thread, and by a shim washer 17 disposed between the nut 19 and the first end of the tube.

A spring 11, for example a helical compression spring, is arranged in the second end region 110, biasing the second end of the rod 9 in a direction away from the second end of the tube 10.

This bias always urges the limit stop 19' against the first end of the tube, thereby keeping the rod 9 and the tube 10 in the first end region 100 in a fixed relationship relative to one another.

When heat is applied to the temperature sensor 7, the rod 9 expands more than the tube 10. As a result, the second end of the rod can move away from the second end of the tube, as indicated by the arrow +T in FIG. 3.

The resulting relative displacement between the second end of the rod and the second end of the tube can provide a measurement value which is directly proportional to the temperature of the sensor 7 and therefore also for the temperature of the environment of the sensor. The length change of the rod 9 is indicated in the Figures by the reference symbol $\Delta L$. The change in length of the tube 10 can essentially be neglected, since the tube is made of ceramic. The measurements can be evaluated in different ways. Most frequently used is a method depicted schematically in the Figures, wherein the second end of the tube activates a switching contact 22' via a transfer element 20. Other devices, such as inductive measurement devices, as described in FIGS. 5, 6 and 7 for the second switch head 8', can also be used for such measurements.

The switching contact 22' can be connected in series with a resistive heating element that heats the surroundings of the temperature sensor 7, in particular the cooking area depicted in FIGS. 1 and 2. This allows the temperature produced in this area to be limited and/or controlled.

The switching contact 22' and transfer element 20 are hereby supported in the switch head 8, on which the second end of the tube 10 is also secured. The second end of the tube and the switching contact 22' are hereby maintained in a fixed relationship with respect to one another. The switching contact 22 can be activated by the second end of the rod that is movably supported in the switch head 8. The transfer element 20 can be implemented as a ram; however, springs or rods of various shapes can also be used as transfer elements.

The relative displacement between the second end of the tube and the second end of the rod can be measured in different ways, for example, by measuring the expansion of the rod with a strain gauge, by inductive sensors (for example, solenoid rams attached to the second end of the rod) or by optical sensors (light barrier). The required elements can be housed in the switch head 8.

The measurement results can also be used for other purposes, for example for indicating the temperature or for signaling that the temperature has exceeded a certain value.

The embodiment of FIG. 4 operates according to the same basic principle. In this embodiment, however, the tube 10 has a greater thermal expansion coefficient than the rod 9. In the first end region 100, the tube 10 is closed, for example, with a plug 17' made of metal and welded to the tube 10, with the end face of the rod 9 contacting the plug 17'. The second end of the tube 10 is again secured to the switch head 8, whereas the second end of the rod 9 is movably supported in the switch head 8 and urged into the tube 10 by a spring 11.

When the temperature increases, the tube 10 expands, whereby the second end of the rod 9 is moved towards the tube 10 (see arrow +T). This relative movement can be processed in different ways, and used, for example, to activate a switching contact 22'.

According to the present invention, a temperature limiter can be constructed in a modular fashion to include a temperature sensor 7 of the aforedescribed type and a switch head 8 connected thereto. In other words, an additional switch head 8' which has an additional device 80' for measuring the relative displacement of the expansion elements 9, 10, can be coupled to the switch head 8.

Figure 5:
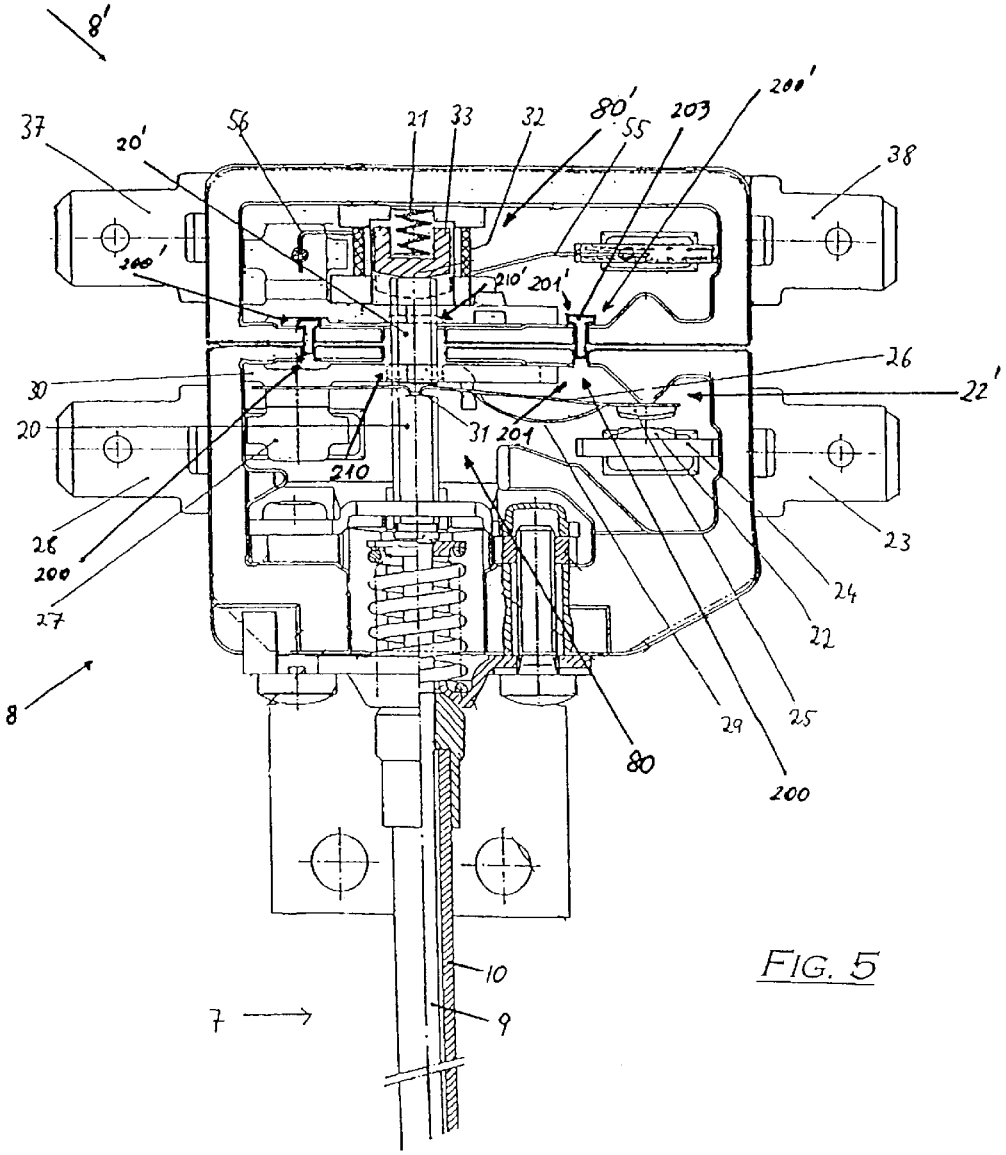
FIG. 5 is a partial cross-section of an embodiment of a temperature limiter according to the invention with a first switch head and a second switch head, with both switch heads uncovered.

FIG. 5 illustrates a switch head 8 according to the invention with a temperature sensor 7 and an attached second switch head 8'. As seen in FIG. 5, the switch head 8 includes attachment means 200 in form of threaded bores 201 disposed on a side of the switch head 8 opposite to the side of the temperature sensor 7. The second switch head 8' is attached by screws 203 which engage with the threaded bores 201 via bores 201' disposed in the housing of the second switch head 8'. In addition, bores 210 and 210' are provided through which a second transfer element 20' is guided, which transmits the relative displacement of the rod 9 relative to the measurement device 80' located in the second switch head 8'.

The temperature sensor 7 has again a rod 9 guided in a tube 10, wherein the rod and the tube have different thermal expansion coefficients. Rod 9 and tube 10 are held in the aforedescribed manner in the first end region 100 so that they are unable to move relative to one another, and in the second end region 110 in the switch head 8 so that they can move relative to one another.

The measurement device 80 is implemented in FIG. 5 by a switching contact 22'. The switching contact 22' includes a contact 22 fixedly attached in the switch head 8 and connected via a contact support 24 with a terminal lug 23. The fixed contact 22 cooperates with a moveable contact 25 which is held on a contact spring 26 supported on a contact support 27 and connected electrically with another terminal lug 28. The contact spring 26 includes a stamped tab 29 which is supported by a support 30 connected with a contact support 29 and the contact spring 26.

The transfer member 20 contacts the contact spring 26 approximately in the center region of the contact spring 26 where a transverse shoulder 31 is located. The contact system opens and closes, respectively, following displacement of the transfer member 20 due to temperature changes.

With the present invention, a temperature limiter of the aforedescribed type can be expanded by incorporating an additional switch head 8' disposed on the switch head 8. The additional switch head 8' includes a measurement device 80' which measures the relative displacement of the end of the rod 9 facing the switch head relative to the switch head 8.

Figure 9:
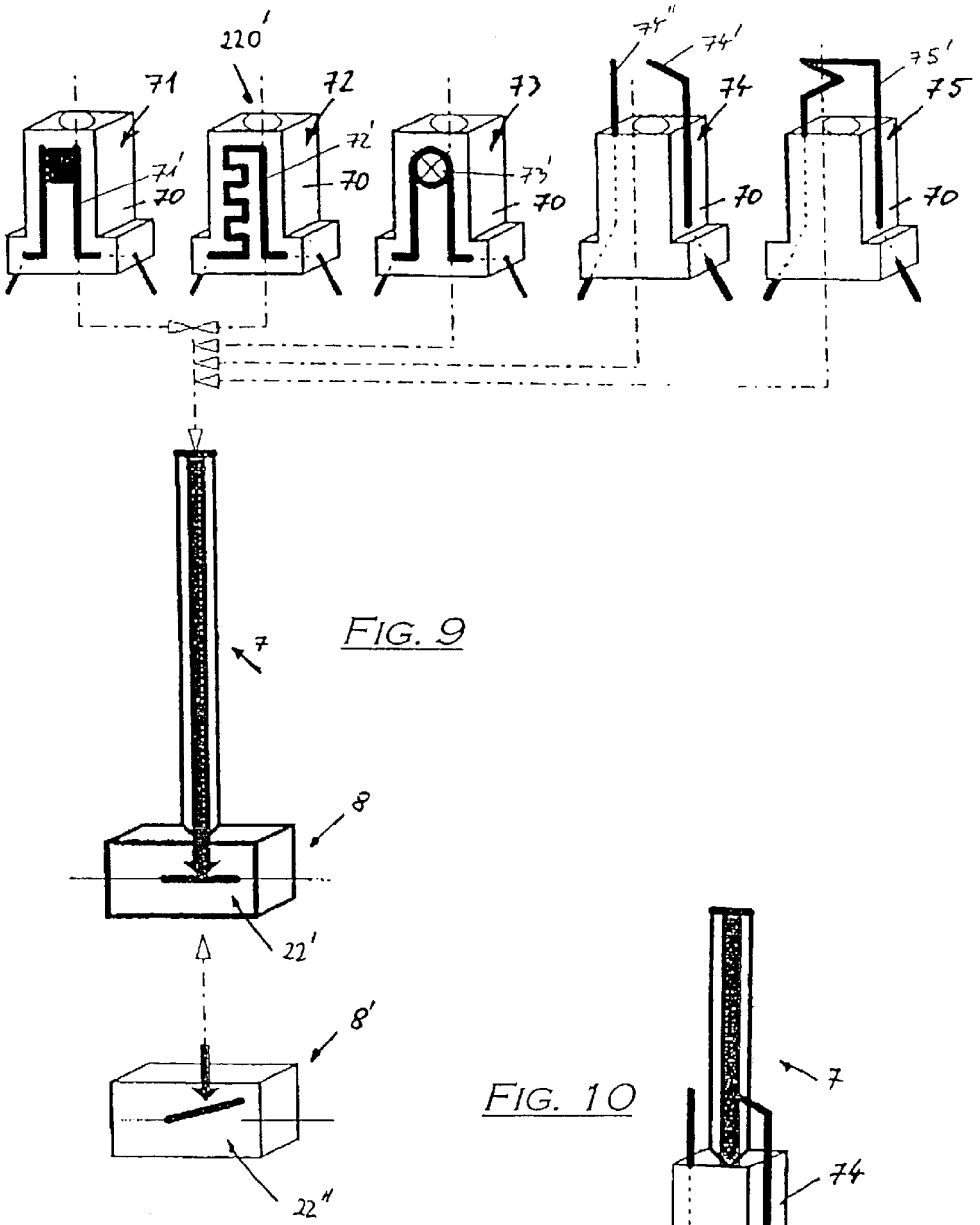
FIG. 9 is a schematic diagram of an embodiment of a temperature limiter according to the invention having a modular construction.

In a preferred embodiment of the invention, the device 80' arranged in the second switch head 8' is also formed by switching contact 22" to which the relative displacement is transferred (see FIG. 9).

In general, the device 80' which is arranged in the second switch head 8' and measures the relative displacement, is used to indicate a hot area, for example to warn against touching a hot location on the cooking surface. However, a combination with other measurement devices is also possible. In particular, measurement devices can be implemented wherein the relative displacement is converted into an analog electrical signal (see FIG. 5). The switch head 8 depicted in FIG. 5 therefore provides for a modular construction of arbitrary temperature limiters. Temperature limiters consist of a temperature sensor 7 and a switch head 8 which can hence be easily constructed to include various extensions.

Figure 13:
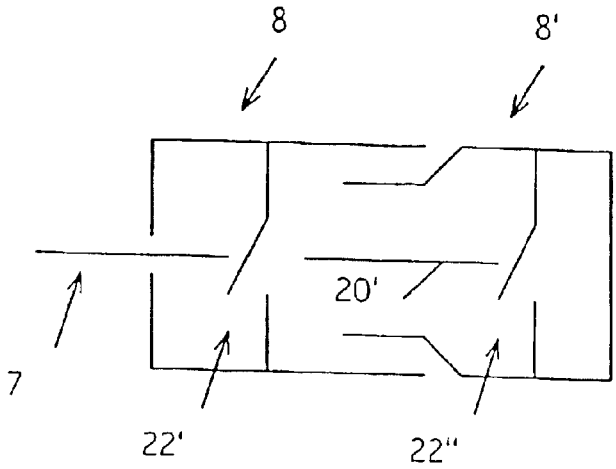
FIG. 13 is a schematic diagram of a temperature limiter according to the invention, wherein the openings in two switch heads are formed by eliminating a side wall of the switch heads.
Figure 14:
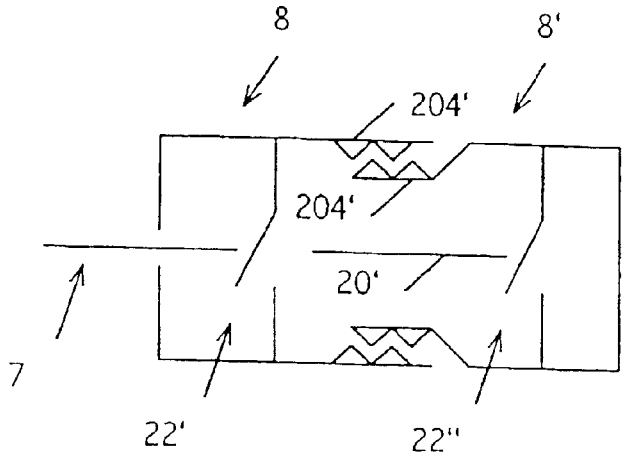
FIG. 14 is a schematic diagram of a temperature limiter according to the invention, wherein two switch heads are connected by threads.

To attach the second switch head 8', threaded bores 201 engaging with screws 203 are provided in the housing of the first switch head 8. However, other fastening means, such as tabs or clamps and openings adapted to engage with the tabs or clamps can also be used. Alternatively, the second switch head 8' can also be completely enclosed in the switch head 8 (FIG. 13), or the other switch head 8' can be provided with a thread 204' adapted to engage with a thread 204 disposed on the first switch head 8 (FIG. 14). In all these embodiments, a fastening means 200' is provided on the second switch head 8' that is complementary to the fastening means on the first switch head 8.

To transfer the relative displacement of the expansion elements 9, 10 to the second switch head 8', there is provided in FIG. 5 an additional ram serving as an additional transfer member 20'. However, other elements, such as rods or springs, can also be used as transfer members. The switch heads 8, 8' can be implemented independently of one another, wherein the additional transfer member 20' can be either implemented in the first switch head 8 or the second switch head 8'.

Figure 15:
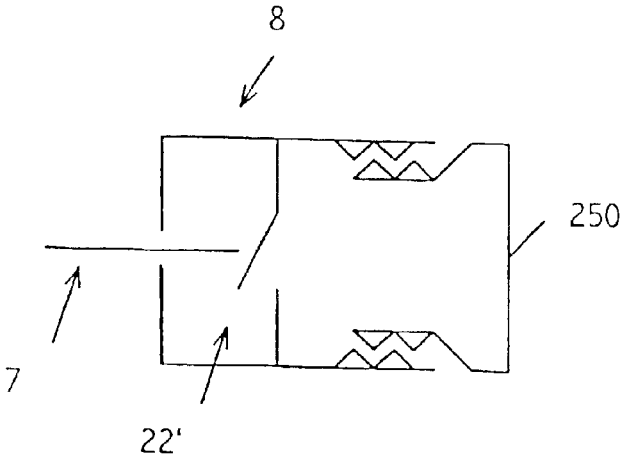
FIG. 15 is a schematic diagram of a switch head according to the invention and closed by a cover.

Openings in the form of bores 210 and 210' adapted to receive the transfer member 20' are provided in the switch heads 8 and 8'. Alternatively, one or both switch heads 8, 8' can be constructed so that the openings for receiving the transfer member 20' is implemented by omitting one side of the housing of the switch head, as indicated schematically in FIGS. 13 and 14. In this case, a cover 250 can be provided which closes the respective switch head 8, 8', if no second switch head is secured to the first switch head (FIG. 15). A cover 250 can be provided for either the first switch head 8 or the second switch head 8' or for both. Moreover, the cover 250 can be secured with the existing fastening means 200 and/or 200', wherein additional fastening means can be provided for the cover 250.

Figure 8:
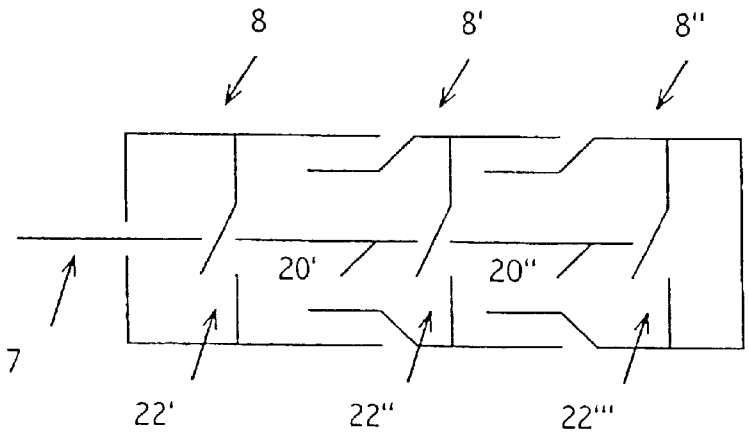
FIG. 8 is a schematic diagram of another embodiment of a temperature limiter according to the invention with several switch heads secured to the first switch head.

FIG. 5 shows a switch head according to the invention, with one additional switch head 8' attached to the switch head. However, with a modularly constructed entire module, additional switch heads 8" can be secured to the second switch head 8' (FIG. 8). This arrangement can be used to construct, for example, two-step heat indicators based on simple contacts measuring the relative displacement. Conditions, such as "cold", "warm" and "hot", of the cooking area could be indicated by multicolored lamps.

Figure 6:
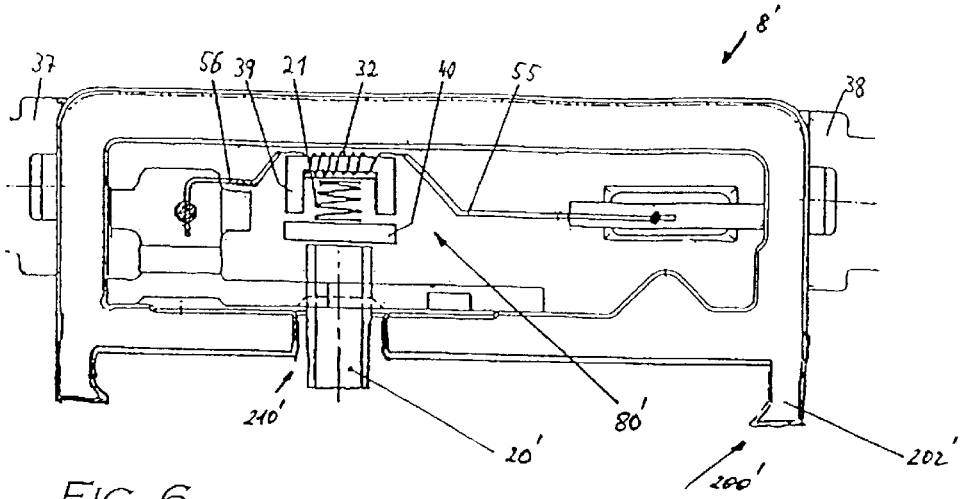
FIG. 6 is another embodiment of the second switch head according to the invention.
Figure 7:
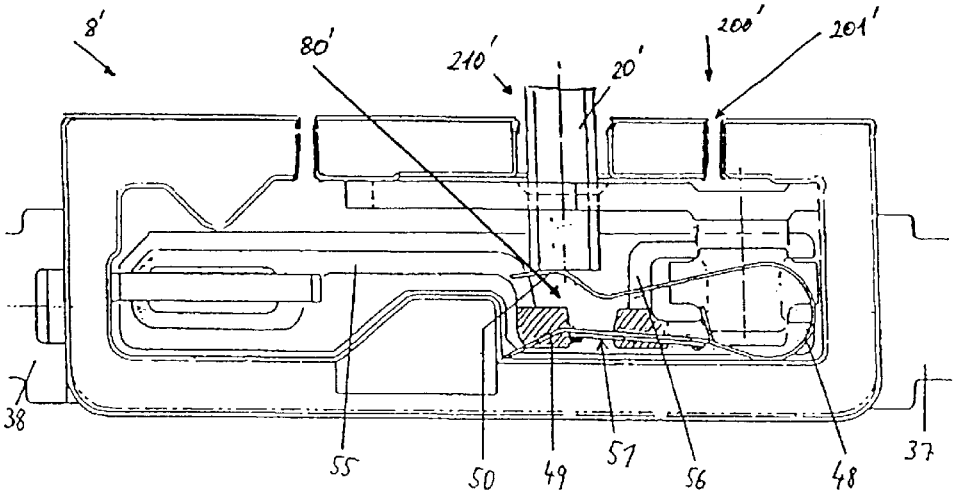
FIG. 7 is another embodiment of the second switch head according to the invention, with a strain gauge for measuring the relative displacement of the expansion elements.

FIGS. 5–7 show additional embodiments 80' for measuring the relative displacement of the rod 9 in the second module or switch head 8'. Optionally, these and/or other devices can be located in the first switch head 8 and the additional devices in additional modules. For example, a measurement device providing an analog electrical output signal can be produced.

In an embodiment of a measurement device, an inductive sensor in the form of a simple solenoid ram sensor could be used, as illustrated in FIG. 5. This solenoid ram sensor is made of a coil 32 with a moveable iron core 33 extending between the transfer member 20' and the spring 21.

The second transfer member 20' moves together with the transfer member 207 whereby the rod 9 moves the iron core 33. This can be achieved, as shown in FIG. 5, simply by placing the transfer member 20' on the spring 26. In another embodiment of the invention, the first transfer member 20 can extend past the contact spring 26, thereby catching the second transfer member 20'. In this case, the contact spring 26 can have openings through which the transfer member 20 is guided. In this case, the transfer member 20 can have a shoulder located in the region of the transverse shoulder 31 of the contact spring and moving the contact spring 26.

The measurement device 80' is connected via electrical lines 55, 56 with terminal lugs 37, 38, which in turn can be connected with a circuit (not shown) that processes the measurement signal for display.

The inductive sensor of FIG. 6 is a transverse armature sensor, wherein the coil 32 is located on a leg of a U-shaped core 39. The magnetic circuit is closed by a transverse armature 40, which is spaced apart from the core 39 and connected with the transfer member 20'. A temperature change causes movement of the transverse armature 40, thereby changing its distance to the core 39, which in turn changes the inductance of the core 32.

The fastening means 200' depicted in FIG. 6 are formed by lugs 202' which can engage with corresponding openings in the switch head 8 and a thereby enable a rigid releasable connection between the two switch heads 8, 8'.

FIG. 7 shows a temperature limiter, wherein a U-shaped spring 48 is provided for pretensioning the transfer member 20 in the direction of the rod 9. The first leg 49 of the transfer member 20 is supported on the switch head 8', and the second leg 50 is supported on the transfer member 20'. The measurement device is hereby formed by a strain gauge 51 secured to the U-shaped spring 48.

In all the aforedescribed embodiments, the electrical lines 55, 56 extending between the measurement device 80' and the corresponding terminal lugs 37, 38 are preferably formed by strip conductors that are directly applied to a thin ceramic plate. The strip conductors can be attached to the ceramic plate by a so-called "direct-copper-bonding" (DCB) method which provides a particularly strong bond between the copper and the ceramic.

Wheatstone bridges, which convert changes in the resistance into changes of the output voltage, can be used to process the signal produced by the measurement device. In embodiments of the measurement device where the resistance value is complex, i.e., includes an inductive or capacitive component (FIGS. 5 and 6), the Wheatstone bridges are operated with AC voltage.

A display connected after the processing circuit can be implemented by employing, for example, several sequentially arranged lamps, wherein the number of illuminated lamps changes depending on the output signal of the measurement device. Alternatively, an illumination device that changes color depending on the measurement signal can be employed, or an instrument with a moving needle can be used.

Figure 11:
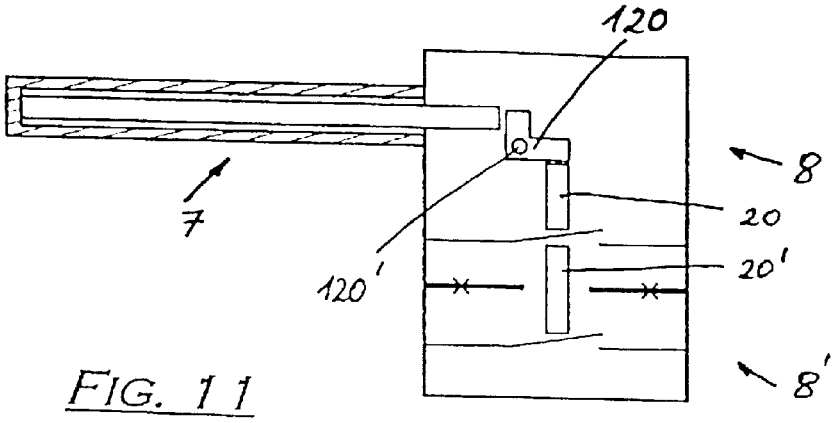
FIG. 11 is a schematic diagram of an embodiment of the temperature limiter according to the invention, wherein the second switch head is not connected to the side of the switch head 8 opposite the temperature sensor.
Figure 12:
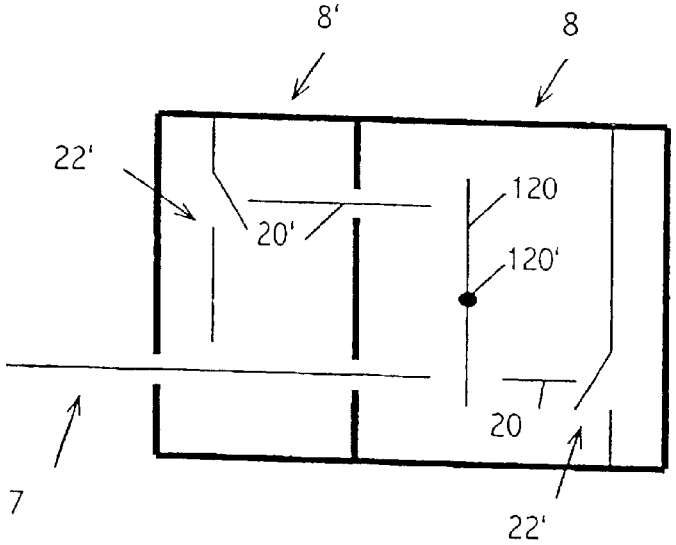
FIG. 12 is another schematic diagram of an embodiment of the temperature limiter according to the invention, wherein the second switch head is not connected to the side of the switch head located opposite the temperature sensor.

In all the aforedescribed embodiments of the invention, the second switch head 8' is attached on the side of the switch head 8 opposite from the temperature sensor 7. However, this is not required, as illustrated in the embodiment depicted in FIG. 11. Here, the relative displacement of the expansion elements is deflected by a transfer member 120 into a second direction transverse to the original direction of expansion. Additional switch heads 8' can also be provided on the side of the temperature sensor 7, wherein the relative displacement of the expansion elements is deflected accordingly (FIG. 12). In the embodiment depicted in FIGS. 11 and 12, the relative displacement is deflected by a straight or L-shaped beam, which is supported for rotation about a bolt 120'. With this arrangement, the additional switch heads 8', 8" can also be attached in other areas of the switch head 8. The transfer member 120 changes the direction of the relative displacement of the temperature sensor into the direction of the second and/or the additional switch heads.

Figure 10:
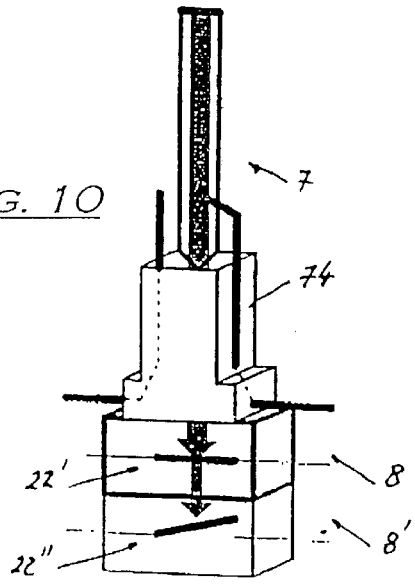
FIG. 10 is a schematic diagram of an embodiment of the modular temperature limiter of the invention for a gas-heated Ceran cooking area.

FIGS. 9 and 10 depict a temperature limiter according to the invention with a modular construction. The temperature limiter includes a switch head 8 according to the invention and a temperature sensor 7. Additional modules 71–75 can be attached in the region of the temperature sensor 7 and additional switch heads 8', 8" can be attached in the region of the switch head 8 opposite the temperature sensor 7. The schematically depicted basic module, consisting of the switch head 8 and the temperature sensor 7, represents a temperature limiter to prevent overheating of a Ceran plate. The indicated contact system 22' can interrupt the power to a heater or disconnect the gas supply to a gas heater.

In the embodiment of the invention depicted in FIG. 9, additional modules can be added to the basic module by placing these additional modules onto the temperature sensor 7. For this purpose, the basic module 17 of the additional modules 71–75 is provided with bores 220'. In addition, a connection to the switch head 8 itself is also possible. For example, fastening elements, such as lugs or threads, can be provided for attachment of the additional modules 71–75 directly on the switch head 8. These fastening elements can provided on the switch head 8 and/or on the additional modules 71–75. Alternatively or in addition, the temperature sensor can operate as a fastening element in that the additional modules are press-fitted on the temperature sensor 7.

In the following, the additional modules depicted in FIG. 9 will be briefly described. In the sensor module for inductively detecting cooking utensils 71, the inductance of the coil 71' monitors the cooking utensils made of conventional materials, such as steel or copper, and placed on the cooking surface. The presence of the cooking utensils 71 modifies the inductance of the coil 71', wherein the change can be detected and evaluated. The material of the cooking utensil as well as its temperature can be characterized from the observed changes in inductance.

The sensor module for analog measurement of the temperature 72 has a temperature-dependent resistor 72', whose resistance value is measured and processed, thereby providing information about the actual temperature of the cooking area. The resistor 72' is generally an ohmic resistor, however other temperature-dependent impedances can also be used. Advantageously, the resistor can be formed by a resistive paste that is printed onto the basic module 17, for example by screen-printing.

Figure 16:
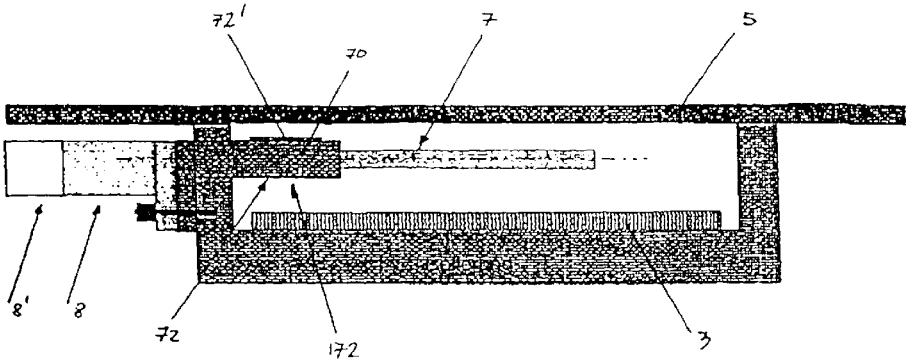
FIG. 16 shows a cross-sectional view through a cooking area taken along the line I—I shown in FIG. 17, with a temperature limiter having a sensor module for indicating the temperature.
Figure 17:
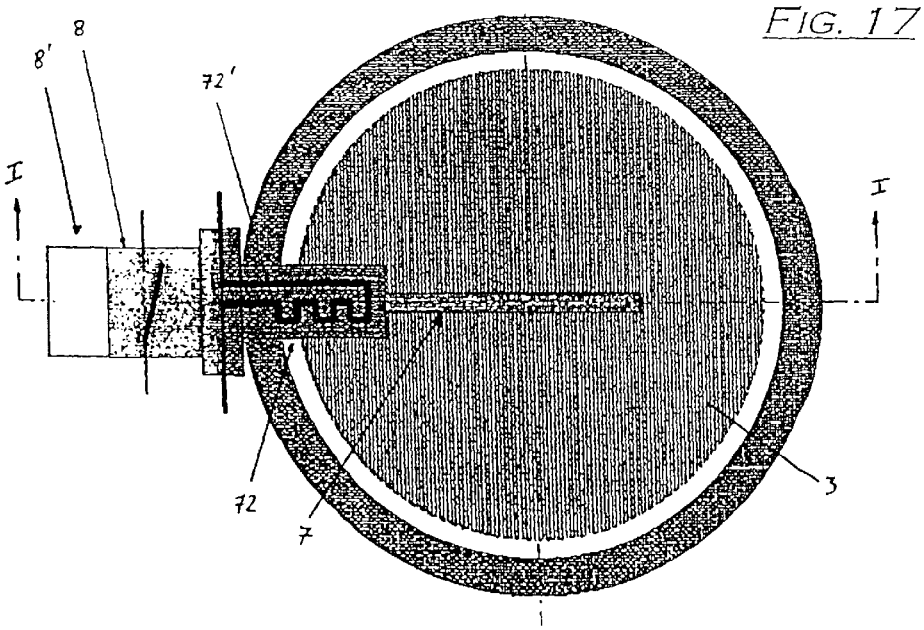
FIG. 17 is a top view of the cooking area of FIG. 16.

During initial heat-up, i.e., when the heater is first turned on, the heating space is frequently heated unevenly. This can cause excessive heating of the temperature sensors 72, which is located closer to the heater coil 3 than the cooking area 5. This can cause the heater to be turned off prematurely, although the cooking surface 5 is no danger of being overheated. This can be prevented by installing a heat shield 172 on the temperature sensor 72 and/or the resistor 72' (see FIG. 16), which prevents the sensor module or the resistor 72' from being heated up too rapidly during heat-up. This can be accomplished by installing heat shielding plates and the like. In a particularly simple embodiment, the mass of the basic module 17 itself forms a heat shield (FIGS. 16 and 17). The resistor 72' is here applied only on one side of the sensor module 72, and the sensor module is arranged in the cooking area so that the basic module 17 is located between the heater coil 3 and the resistor 72', thereby shielding the resistor 72'. Providing a heat shield 172 also prevents the temperature sensor 7 from heating up too quickly during the heat-up phase.

Alternatively, the temperature of the resistor 72' can be made to approximately equal the temperature of the cooking surface 5 by constructing the sensor module 72 and the cooking surface of the same material. Modules made of ceramic/Ceran are particularly advantageous. By using the same material, the resistor 72' will heat up at the same rate as of the Ceran plate of the cooking area.

The display module for indicating hot surfaces 73 can include an indicator 73'. This indicator provides information obtained from close to the dangerous areas if the cooking surface can be touched safely.

The additional modules 74 and 75 represent ignition devices for igniting a gas flame under the Ceran cooking area. Gas-heated cooking areas typically include not only the aforedescribed temperature limiter, but also a device for igniting the gas in the heating space.

An exemplary spark ignition device 74 includes two electrodes 74', 74" which form a spark gap with a predetermined spacing. By applying a suitable voltage to the two electrodes 74', 74", for example between 10 and 20 kV, the generated spark ignites the gas.

An exemplary glow plug device 75 depicted in FIG. 9 for igniting the gas includes a glow coil in form of a heater coil 75 which is secured to the basic module 70.

All the additional modules have bores 220' adapted to receive the temperature sensor 7 which also secures the additional modules on the temperature limiter of the invention.

The second switch head 8' is formed as a residual heat module to indicate when the cooking surface is still hot. The indicated contact 22" characterizes the temperature of the cooking area by two values, namely "too hot to touch safely" and "sufficiently cool to touch safely".

FIG. 10 shows a combination of several modules according to the invention, consisting of a basic module with a temperature sensor 7 and switch head 8, a residual heat module and/or switch head 8', and a spark ignition device 74. The illustrated combination can be used as temperature limiter for gas-heated Ceran cooking areas.

While the invention has been illustrated and described as embodied in temperature limiter, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A temperature limiter, comprising:

a temperature sensor for measuring a temperature below a cooking area, said temperature sensor including elongated expansion elements having different thermal expansion coefficients;

at least one switch head which includes a device for detecting a relative movement between the expansion elements; and an additional module constructed to initiate a heating of the cooking area or monitor a state of the cooking area, said additional module having a base component provided with a bore, wherein the additional module is placed over the temperature sensor or the at least one switch head by way of the bore, wherein the additional module comprises a resistor secured to the base component for monitoring a temperature of the cooking area.

2. The temperature limiter of claim 1, wherein the additional module is directly connected with the temperature sensor or the at least one switch head.

3. The temperature limiter of claim 1, wherein the resistor is formed by a resistive paste.

4. The temperature limiter of claim 1, wherein the resistor is shielded by a heat shield.

5. The temperature limiter of claim 4, wherein the heat shield is formed by a mass of the base component.

6. The temperature limiter of claim 1, wherein the additional module includes an ignition element for igniting a gas flame under the cooking area, said additional module comprising two electrodes secured to the base component and forming a spark gap therebetween.

7. The temperature limiter of claim 1, wherein the additional module includes an ignition element for igniting a gas flame under the cooking area, said additional module comprising a resistive heating element secured to the base component.

8. The temperature limiter of claim 1, wherein the base component is made of a ceramic.

9. The temperature limiter of claim 1, wherein the resistor is an ohmic resistor.

10. The temperature limiter of claim 3, wherein the resistive paste is applied by screen-printing.

11. The temperature limiter of claim 7, wherein the resistive heating element is formed as a helix.

12. The temperature limiter of claim 7, wherein the resistive heating element comprises a glow plug.

13. A temperature limiter, comprising:

a temperature sensor for measuring a temperature below a cooking area, said temperature sensor including elongated expansion elements having different thermal expansion coefficients;

at least one switch head which includes a device for detecting a relative movement between the expansion elements; and an additional module constructed to initiate a heating of the cooking area or monitor a state of the cooking area, said additional module having a base component provided with a bore, wherein the additional module is placed over the temperature sensor or the at least one switch head by way of the bore, wherein the additional module includes an inductive element secured to the base component, said inductive element adapted to detect the presence of a cooking utensil on the cooking area proximate to the inductive element.

14. The temperature limiter of claim 13, wherein the additional module is directly connected with the temperature sensor or the at least one switch head.

15. The temperature limiter of claim 13, wherein the additional module includes an ignition element for igniting a gas flame under the cooking area, said additional module comprising two electrodes secured to the base component and forming a spark gap therebetween.

16. The temperature limiter of claim 13, wherein the additional module includes an ignition element for igniting a gas flame under the cooking area, said additional module comprising a resistive heating element secured to the base component.

17. The temperature limiter of claim 13, wherein the base component is made of a ceramic.

18. The temperature limiter of claim 16, wherein the resistive heating element is formed as a helix.

* * * * *